US006564608B2

(12) United States Patent
Maestrutti et al.

(10) Patent No.: US 6,564,608 B2
(45) Date of Patent: May 20, 2003

(54) ROLLING METHOD AND LINE FOR RAILS OR OTHER SECTIONS

(75) Inventors: Loris Maestrutti, Buttrio (IT); Giorgio Lavaroni, Buttrio (IT); Stefano Zuttion, San Daniele del Friuli (IT)

(73) Assignee: Daniel & C. Officine Meccaniche Spa, Buttrio (IT)

( * ) Notice: Subject to any disclaimer, the term of this patent is extended or adjusted under 35 U.S.C. 154(b) by 0 days.

(21) Appl. No.: 09/938,858

(22) Filed: Aug. 27, 2001

(65) Prior Publication Data

US 2003/0037583 A1 Feb. 27, 2003

(30) Foreign Application Priority Data

Aug. 28, 2000 (IT) ..... UD2000A000159

(51) Int. Cl.[7] ..... B21B 1/00
(52) U.S. Cl. ..... 72/221; 72/235
(58) Field of Search ..... 72/221, 222, 221 F, 72/222 F, 229, 234, 235

(56) References Cited

U.S. PATENT DOCUMENTS

| | | | | | |
|---|---|---|---|---|---|
| 1,812,247 | A | * | 6/1931 | Oberg et al. | 72/225 |
| 2,528,075 | A | * | 8/1945 | Peterson | 72/248 |
| 3,342,053 | A | * | 9/1967 | Stammbach | 72/226 |
| 3,657,912 | A | * | 4/1972 | Ishibashi et al. | 72/234 |
| 4,344,310 | A | * | 8/1982 | Kozono et al. | 72/225 |
| 4,370,877 | A | | 2/1983 | Michaux | |
| 4,393,680 | A | | 7/1983 | Kovacs | |
| 4,503,700 | A | | 3/1985 | Kishikawa | |
| 4,518,660 | A | * | 5/1985 | Faessel et al. | 238/122 |
| 4,791,799 | A | * | 12/1988 | Engel et al. | 72/225 |
| 5,904,061 | A | * | 5/1999 | Engel et al. | 72/229 |

FOREIGN PATENT DOCUMENTS

| | | |
|---|---|---|
| DE | 737673 | 9/1937 |
| DE | 3403901 | 8/1985 |
| DE | 3417500 | 11/1985 |
| DE | 19743633 | 4/1999 |
| EP | 653253 | 5/1995 |
| FR | 2529480 | 1/1984 |
| JP | 3052701 | 3/1991 |

OTHER PUBLICATIONS

J. Desvallees et al "Universal Rolling of Rails–State of the Art" Iron and Steel Engineer, vol. 64, No. 3, pp. 25–31 (Mar. 1987).

K. Becker et al "Revamping of the Rail Rolling Mill Of Thysen Stahl AG", vol. 114, No. 1, pp. 57–63, 119, (Jan. 1994).

Patent Abstracts of Japan, vol. 015, No. 199 (M–1115)(May 22, 1991).

* cited by examiner

*Primary Examiner*—Lowell A. Larson
*Assistant Examiner*—John S Goetz
(74) *Attorney, Agent, or Firm*—Stevens, Davis, Miller & Mosher, LLP

(57) ABSTRACT

Rolling method and line for rails or other sections starting from a steel bar, including a roughing step and a finishing step. The roughing step provides use of a two-high reversible roughing stand, or BDM (Break-Down Mill), associated with a reversible edging stand (RES), which can be located irrespectively upstream or downstream of the BDM stand.

27 Claims, 3 Drawing Sheets

ROLLING METHOD AND LINE FOR RAILS OR OTHER SECTIONS

FIELD OF THE INVENTION

The invention concerns a rolling method and line for any section or metal profile, such as for example, railway lines, starting from billets or blooms, which provides the use of a reversible edging stand (RES) combined with a two-high reversible roughing stand or Break-Down Mill (BDM) and positioned upstream or downstream thereof. Using the RES allows the use of a single BDM stand, irrespective of the starting material, reducing the number of rolling passes in the BDM stand and in all the steps of the rolling sequence.

BACKGROUND OF THE INVENTION

It is well-known that to roll rails and other sections, starting from billets or blooms, a roughing step has to be carried out before the finishing step.

It is also well-known that such roughing step can be carried out using two BDM stands, respectively BDM1 and BDM2 arranged in series, which can have plane and/or shaped rolls, arranged in various ways.

In accordance with a first conventional solution, shown schematically in FIG. 1, the BDM1 stand has two grooved profiles (PS1 and PS2) and is used only for plane passes, while the BDM2 stand, which has a series of six grooved profiles (from PS3 to PS8), is used as a stand to prepare shaped pieces for the subsequent finishing train. This solution entails wide roller tables, about 2.5–3 m, which represents a limit which is difficult to overcome, due to the excessive weight which the rolls would otherwise have, and also due to the constructional complexity, which would weigh on the movement members of the rolls and cause inherently high costs. Therefore, considering the size of the rolls, usually no wider than 3 m, and the size of the sections to be rolled, each rolling roll is provided at most with six grooved profiles.

In accordance with a second conventional solution, shown schematically in FIG. 2, the stands BDM1 and BDM2 have only four grooved profiles each (respectively from PS1 to PS4 and from PS5 to PS8) to allow reducing the width of the roller table.

The state of the art also includes the use of a roughing train of the so-called "open" type, that is, provided with two reversible stands GR1 and GR2, shown schematically in FIG. 3, each having four grooved profiles (respectively from PS1 to PS4 and from PS5 to PS8).

Therefore, conventional rolling lines are not compact and require considerable investment to make civil engineering structures, such as foundations and the plant (sheds) for these lines, since such lines do not allow concentration of the roughing operations, upstream of the finishing train, in a limited area.

U.S. Pat. No. 5,904,061 discloses a method of rolling finished sections from a preliminary rolling group constituted by a vertical two-high reversing stand (VVG) followed by a horizontal two-high reversing stand (VHG) with two shaped grooves. The VVG provides only for a simple upsetting of the base and head of the rail section. The emerging rail section is rolled in a reversing operation after three or more passes in the universal stand and in two alternative grooves of an intermediate upsetting stand. The section is finish-rolled into a rail section in an additional pass through the universal stand. This known method provides that the starting product is already shaped as function of the final product to be obtained. The first profile of the VHG (i.e. WH1) is already shaped and the VVG is not exclusively used in combination with the first profile (WH1) of VHG, but also with the other profile (WH2). FR-A-2,529,480 discloses a method for rolling rail from a hot-rolled bloom having a square or rectangular cross section, wherein the method comprises the steps of breakdown rolling, universal rolling, which is effected by causing the bloom to travel through a plurality of stands making only a single pass on each stand, base-wheel rolling, head-wheel rolling and edging. The bloom is broken down into substantially H-shaped beam blank whose cross section is symmetrical with respect to the center line of its web. In the base-wheel rolling, the flanges of the blank corresponding to the head and base of the rail are respectively rolled widthwise and thicknesswise in three or more passes using a pair of horizontal rolls and a vertical roll, respectively. Also in this case the vertical stand (VE) performs only a simple upsetting of the heads of such H-shaped profile before entering the finishing section of the rolling line and, additionally, is not utilized in alignment with the grooved profile of substantially rectangular form.

DE-A-19743633 discloses a method of rolling finished sections from preliminary sections by means of roll stand arrangements which operate in reversing operation and include a compact rolling group composed of a first universal stand at the entry side and a second universal stand at the exit side and an intermediate edging stand arranged between the universal stands, and a roughing group arranged in front of the compact rolling group and composed of vertical non-reversing roll stands (VG) and horizontal roll stands (HG) having three shaped grooves. A rectangular preliminary section or a preliminary section having the approximate final dimensions is pre-shaped in the roll stands of the roughing rolling group in a number of shape changing passes and/or shape reduction passes. Subsequently, the section is further shaped in the compact rolling group in several shape changing passes or shape reduction passes in the universal stand on the entry side. Subsequently, the section is shaped into the finished section in the universal stand on the exit side or in the intermediate edging stand, possibly also with the use of the selectable grooves or the grooves of the roll stands located next to each other. In this rolling line, the vertical stand VG solely performs a simple finishing of the edges of the starting product. The first profile of HG has not a substantially rectangular shape, but it is shaped.

The present Applicant has devised and perfected the rolling method and line for rails or other sections according to the invention to overcome disadvantages of the state of the art.

SUMMARY OF THE INVENTION

One of the purposes of the invention is to obtain rails or other sections using a compact, simple and economical rolling line and method, wherein it is not necessary to rotate the bar being worked as it passes from one grooved profile of the rolling rolls to the other.

In accordance with the purpose, the rolling method and line according to the invention provide to use an edging stand only for the edging operations, thus leaving the roughing operations and the preparation of the shaped pieces to a single BDM stand, in order to reduce the equipment necessary for the roughing/preparatory rolling sequences.

The edging stand can be arranged irrespectively. upstream or downstream of the BDM stand, according to the starting material and the rolling sequence.

We thus obtain a very compact reversible roughing assembly which can be defined as a Reversible Compact Roughing Mill (RCRM).

Compared with the state of the art, the rolling method and line according to the invention have at least the following advantages: a very compact layout of the rolling line; a reduction in the main rolling equipment used and the relative operating spare parts; reduced investment costs thanks to the reduction of the mechanical and electrical equipment, and the civil engineering structures, such as the foundations and the plant; and concentration of the roughing operations for the billets/blooms in a limited area, with a consequent reduction in the times needed to handle the rolled product; an increase in productivity of the roughing zone compared with conventional solutions as in the state of the art; improved functioning of the zone where the stands are changed and prepared thanks to the limited bulk and weight of the equipment; and better control of the rolling temperature due to compacting the roughing area.

To be more exact, the edging stand used in the method and line according to the invention operates at a convenient distance with respect to the BDM stand, upstream or downstream thereof, on the same working axis and has the following characteristics:

The rolling rolls can be cantilevered or have a double support; the whole stand can be displaced both laterally and vertically to be positioned on the working axis or off-line, when it is not being used or for change-over operations; it is possible to use shaped rolling rolls or rings, or a plane table; the command motor can be positioned either below or laterally with respect to the rolling axis.

BRIEF DESCRIPTION OF THE DRAWINGS

These and other characteristics of the invention will become clear from the following description of a preferred form of embodiment given as a non-restrictive example, with the aid of the attached Figures wherein.

DETAILED DESCRIPTION OF A PREFERRED FORM OF EMBODIMENT

Figure 1:
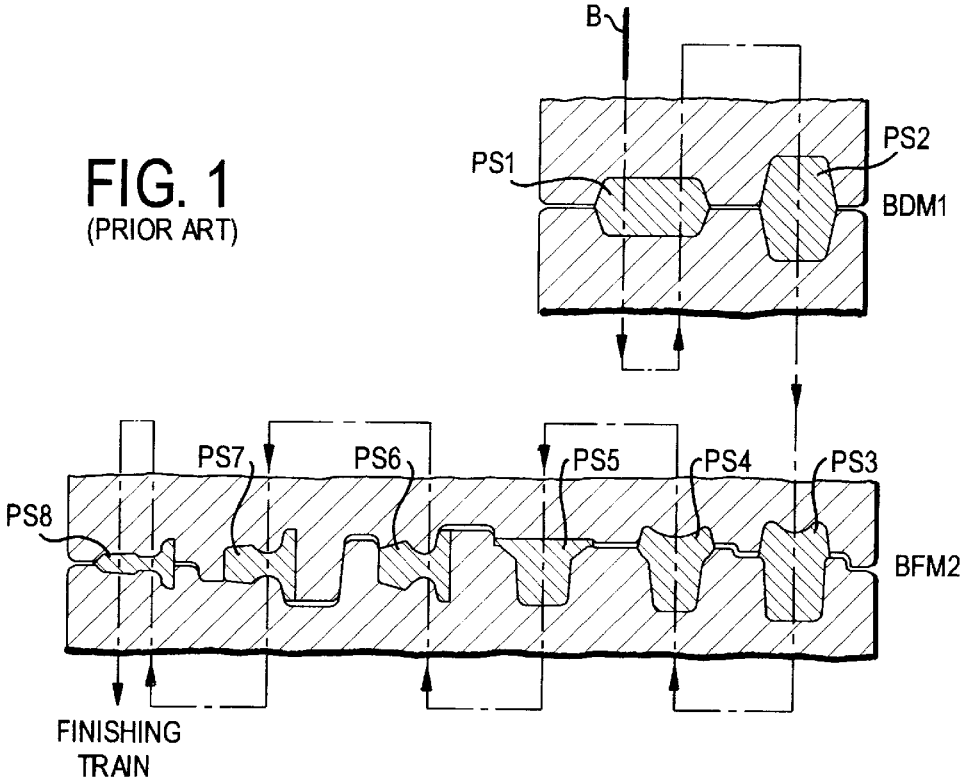
FIG. 1 (PRIOR ART)
FIGS. 1, 2 and 3 are schematic views of three embodiments according to the prior art.
Figure 2:
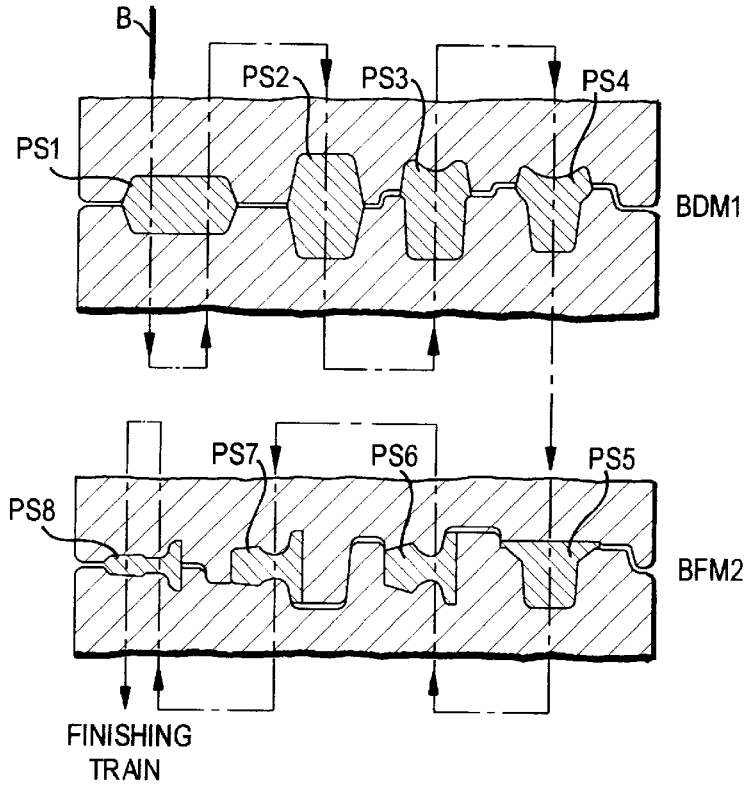
FIG. 2 (PRIOR ART)
Figure 3:
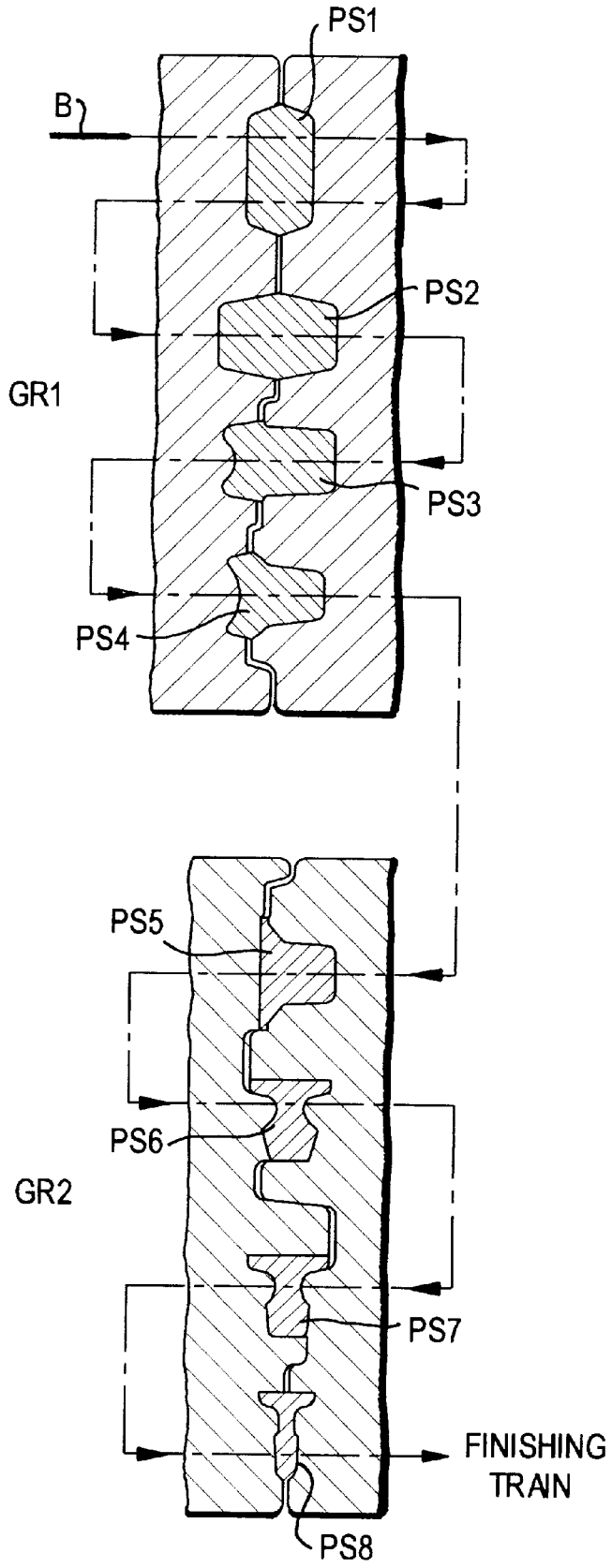
FIG. 3 (PRIOR ART)
Figure 4:
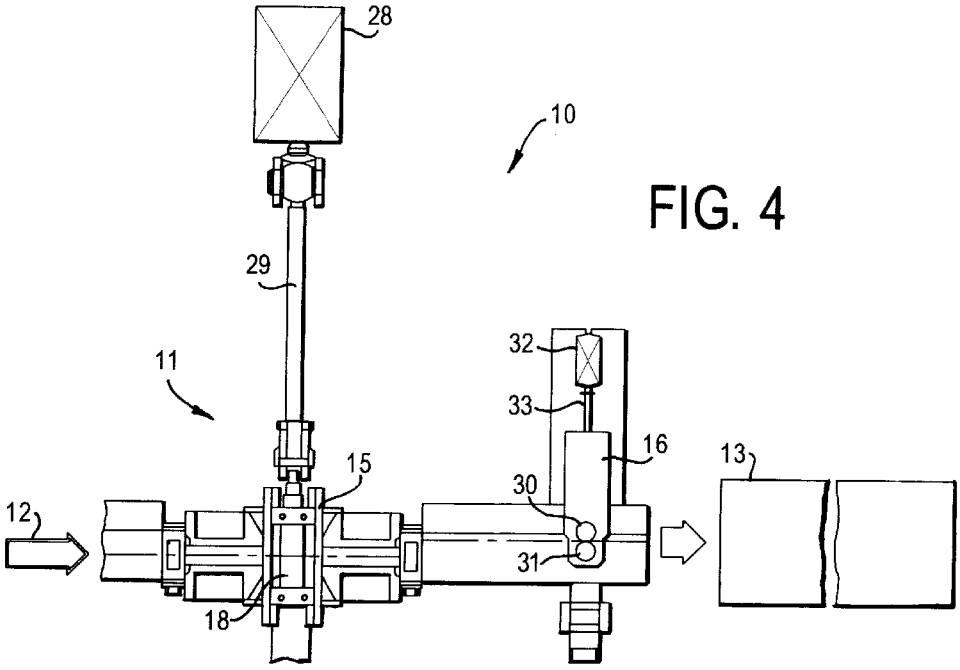
FIG. 4 is a schematic view from above of a rolling line according to the invention.

With reference to FIG. 4, a rolling line 10 for rails or other sections, according to the invention, comprises a roughing assembly 11, able to receive at inlet a bar of steel 12 in the form of a billet or bloom, arriving for example from a continuous casting machine or from a storage unit not shown in the drawings, and a finishing train 13 of a conventional type, for example composed of universal and/or horizontal stands in a reversible or continuous layout, not shown in the drawings.

The roughing assembly 11 comprises in turn a reversible two-high roughing stand 15, better known as BDM (Break-Down Mill), and a reversible edging stand 16 (RES).

Figure 5:
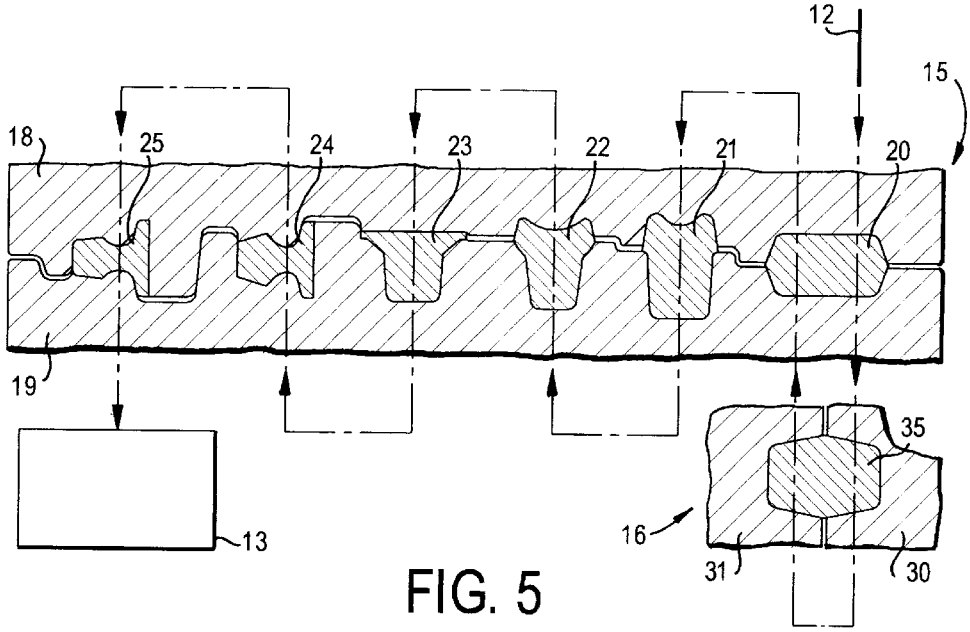
FIG. 5 is a schematic representation of the shaped profiles of the rolling rolls of two stands in the line shown in FIG. 4.

The BDM stand 15 comprises two working rolls 18 and 19 (FIG. 5) shaped so as to define six grooved profiles 20, 21, 22, 23, 24 and 25. In the first grooved profile 20, which has a substantially rectangular transverse section, the bar 12 is able to pass twice, first in one direction and a second time in the opposite direction, while in the other profiles 21–25 the bar 12 is able to pass only once, as shown by the line of dashes in FIG. 5, or several times.

Generally speaking, the width of the working rolls 18 and 19 is about 2.5 m and the interaxis between the profiles 20–25 varies between about 340 and 460 mm.

The rolls 18 and 19 are connected to a first motor 28 (FIG. 4) by means of spindles 29. The motor 28 can be positioned either below or laterally with respect to the rolls 18 and 19.

Suitable means of a conventional type are able to translate the bar 12 axially to arrange it in alignment with the appropriate profile 20–25 and achieve the rolling sequence.

According to a variant, suitable means, also of a conventional type, are able to translate the working rolls 18 and 19 axially to displace cyclically one of the profiles 20–25 in alignment with the rolling axis.

The edging stand 16 comprises two working rolls 30 and 31, arranged with their axes orthogonal with respect to those of the working rolls 18 and 19 of the BDM stand 15 and commanded by a second motor 32 by means of spindles 33. The working rolls 30 and 31 can be mounted either cantilevered or with a double support.

The working rolls 30 and 31 are shaped so as to define a single grooved profile 35, having a cross-section substantially rectangular or squared, in which the bar 12 is able to pass twice, once in one direction and a second time in the opposite direction, after exiting from the profile 20 of the rolls 18 and 19, and before returning therein.

In this way, the bar 12 between the inlet to the roughing assembly 11 and the outlet thereof, before entering the finishing train 13, is subjected to nine or more passes in all, during which it assumes its roughed shape given to it by the last grooved profile 25. This intermediate product which has the roughened shape is then sent to the finishing train 13.

Alternately, the bar 12 can be worked only during the first pass through the grooved profile 35 and not be gripped during the return journey towards the BDM stand 15.

The distance between the edging stand 16 and the BDM stand 15 is chosen according to the length of the bar 12 to be rolled, which may for example be about 12 m.

The electric control of the two stands 15 and 16 can be of the torque control type (drawing control), with an electric shaft after the bar inlet, or without any torque control, making the edging stand 16 independent from the BDM stand 15.

The edging stand 16 is also provided with means to adjust the gap between the working rolls 30 and 31 during rolling, that is, loaded.

The method according to the invention therefore provides to use a single BDM stand 15 associated with a single reversible edging stand 16, arranged upstream of the finishing train 13.

The number of rolling passes in the edging stand 16 will be determined according to the sizing applied for every individual final product.

The edging stand 16 can operate both continuously with the BDM stand, or independently thereof.

Moreover, the edging stand 16 can be both fixed or shifting. In this second case, it can move either laterally or vertical to be positioned on the working axis or off-line.

In order to reduce stopped production times, the working rolls 18, 19 and 30, 31 are associated with fast change devices of a conventional type.

It is apparent that modifications or additions may be made to the rolling line 10 and the relative method as described heretofore, without departing from the spirit and scope of the invention.

It is also apparent that, although the invention has been described with reference to a single specific example, a skilled person shall certainly be able to achieve many other equivalent forms, but these too shall all come within the field and scope of this invention.

What is claimed is:

1. A rolling method for sections starting from a steel bar, comprising:

a roughing step to shape said steel bar into a roughened shape comprising:

passing said steel bar through a Break-Down Mill (BDM) stand, the BDM stand comprising a two-high reversible roughing stand, and passing said steel bar through at least a Reversible Edging Stand (RES) located irrespectively upstream or downstream of said BDM stand, wherein said RES comprises two first working rolls shaped to define one grooved profile having a cross-section substantially rectangular or squared, and said steel bar passes at least once through said grooved profile of said two first working rolls, wherein said BDM stand has second working rolls shaped to define a plurality of grooved profiles, wherein said plurality of grooved profiles comprises a first grooved profile with a substantially rectangular cross-section, and said steel bar passes at least once through said first grooved profile of said second working rolls, and wherein said grooved profile of said first working rolls is substantially aligned with said first grooved profile of said second working rolls, wherein said steel bar performs at least one step selected from the group consisting of passing from the first grooved profile of said second working rolls to said grooved profile of said two first working rolls and passing from said grooved profile of said two first working rolls to said first grooved profile of said second working rolls; and a finishing step comprising finishing said steel bar having a roughened shape after the roughing step.

2. A rolling method as in claim 1, wherein said steel bar passes through the first grooved profile of said second working rolls and through said grooved profile of said two first working rolls at least twice, a first time in one direction and a second time in the opposite direction and, after passing through said first grooved profile of said second working rolls and said grooved profile of said two first working rolls at least twice, passes through other said grooved profiles of said second working rolls.

3. A rolling method as in claim 1, wherein said steel bar passes at least twice in said grooved profile of said first working rolls, a first time in one direction and a second time in the opposite direction, after exiting from said first grooved profile of said second working roll.

4. A rolling method as in claim 1, wherein said plurality of grooved profiles of the second working rolls comprises five further profiles adjacent to said first grooved profile, through which said steel bar passes at least once.

5. A rolling method as in claim 1, wherein a number of rolling passes in said RES is determined according to the sizing applied to each individual final product.

6. A rolling method as in claim 1, wherein said RES operates continuously with said BDM stand.

7. A rolling method as in claim 1, wherein said steel bar translates transversely to selectively align said steel bar with each of said grooved profiles of said second working rolls to achieve a rolling sequence.

8. A rolling method as in claim 1, wherein said passing the steel bar through the BDM stand comprises shifting the second working rolls to selectively align each of said grooved profiles of said second working rolls with a rolling axis of the BDM stand to achieve a rolling sequence.

9. A rolling method as in claim 1, wherein said RES operates independently with respect to the operation of the BDM stand.

10. A rolling method as in claim 1, wherein said steel bar passes through the first grooved profile in the BDM stand;

then said steel bar passes from the first grooved profile in the BDM stand to the RES;

then said steel bar passes through the RES at least twice, a first time in one direction and a second time in an opposite direction, then said steel bar passes from the RES to the first grooved profile, and then said steel bar passes through other said grooved profiles.

11. A rolling method as in claim 1, wherein said steel bar passes through the RES;

then said steel bar passes from the RES to the first grooved profile in the BDM stand;

then said steel bar passes through the first grooved profile in the BDM stand at least twice, a first time in one direction and a second time in an opposite direction, then said steel bar passes from the first grooved profile to the RES, and then said steel bar passes through other said grooved profiles.

12. A rolling method as in claim 1, wherein said RES comprises two first working rolls shaped to define only one grooved profile having a cross-section substantially rectangular or squared.

13. A rolling line for sections starting from a steel bar, comprising:

a roughing assembly comprising:

a Break-Down Mill (BDM), said BDM comprising at least a two-high reversible roughing stand, able to receive at inlet said steel bar, and a Reversible Edging Stand (RES) located irrespectively upstream or downstream of said BDM stand, wherein said RES comprises two first working rolls shaped to define one grooved profile having a cross-section substantially rectangular or squared, wherein said BDM stand has second working rolls shaped to define a plurality of grooved profiles, wherein said plurality of grooved profiles comprises a first grooved profile with a substantially rectangular cross-section for passing said bar therethrough at least once, and wherein said grooved profile of said first working rolls is substantially aligned with said first grooved profile of said second working rolls, and a finishing train arranged downstream of said roughing assembly.

14. A rolling line as in claim 13, wherein said plurality of grooved profiles of the BDM stand comprises five further grooved profiles, adjacent to said first grooved profile, for passing said steel bar therethrough at least once.

15. A rolling line as in claim 13, wherein the width of said second working rolls is about 2.5 m and the interaxis between the profiles of said plurality of profiles is in a range between about 340 and 460 mm.

16. A rolling line as in claim 13, comprising displacement means for axially translating said second working rolls to selectively align each of said grooved profiles of said second working rolls with a rolling axis of the BDM stand to achieve a rolling sequence.

17. A rolling line as in claim 13, comprising displacement means to translate said steel bar transversely and selectively align said steel bar with each of said grooved profiles of said second working rolls to achieve a rolling sequence.

18. A rolling line as in claim 13, wherein said first working rolls of the RES are arranged with their axes of rotation orthogonal with respect to the axis of rotation of said second working rolls of the BDM stand.

19. A rolling line as in claim 13, wherein said second working rolls are connected to a first motor, said first motor is positioned either below or laterally with respect to said second working rolls.

20. A rolling line as in claim 13, wherein said first working rolls are mounted either cantilevered or with a double support.

21. A rolling line as in claim 13, wherein the distance between said RES and said BDM stand is chosen according to the length of said steel bar.

22. A rolling line as in claim 13, further comprising a torque control for said RES and said BDM stand as a drawing control comprising an electric shaft after the bar inlet.

23. A rolling line as in claim 13, wherein said RES comprises means for adjusting a gap between said first working rolls of the RES during rolling.

24. A rolling line as in claim 13, wherein said RES is mounted fixed or shiftable with respect to the working axis.

25. A rolling line as in claim 9, wherein said first and second working rolls are associated with fast change devices.

26. A rolling line as in claim 13, wherein the control of said RES and said BDM stand is without any torque control, such that said RES operates independently from said BDM stand.

27. A rolling line as in claim 13, wherein said RES comprises two first working rolls shaped to define only one grooved profile having a cross-section substantially rectangular or squared.

* * * * *

UNITED STATES PATENT AND TRADEMARK OFFICE

CERTIFICATE OF CORRECTION

PATENT NO. : 6,564,608 B2
APPLICATION NO. : 09/938858
DATED : May 20, 2003
INVENTOR(S) : Loris Maestrutti et al.

It is certified that error appears in the above-identified patent and that said Letters Patent is hereby corrected as shown below:

TITLE PAGE, ITEM (73) ASSIGNEE:
Assignee "Daniel & C. Officine Meccaniche Spa" should read --Danieli & C. Officine Meccaniche SpA--

Signed and Sealed this

Fourth Day of September, 2007

JON W. DUDAS
*Director of the United States Patent and Trademark Office*